US005586669A

United States Patent [19]

Seay et al.

[11] Patent Number: 5,586,669

[45] Date of Patent: Dec. 24, 1996

[54] CUSHIONING UNIT FAULT DETECTOR

[75] Inventors: O. Elwyn Seay, Fort Worth; Stephen K. Nickles; John E. Haley, both of Burleson, all of Tex.

[73] Assignee: FM Industries, Inc., Fort Worth, Tex.

[21] Appl. No.: 433,725

[22] Filed: May 3, 1995

[51] Int. Cl.[6] ..... B61G 7/00

[52] U.S. Cl. ..... 213/43; 213/1 R; 213/223; 340/438; 340/687

[58] Field of Search ..... 213/43, 40 R, 213/9, 7, 75 R, 220, 221, 223, 1 R; 116/281, 283; 267/64.28; 188/284, 299; 340/438, 439, 440, 688, 687; 33/DIG. 15

[56] References Cited

U.S. PATENT DOCUMENTS

| | | | |
|---|---|---|---|
| 3,833,094 | 9/1974 | Grossman | 340/438 |
| 4,317,105 | 2/1982 | Sinha et al. | 340/438 |
| 4,458,234 | 7/1984 | Brisard | 340/438 |
| 5,469,978 | 11/1995 | Bankos et al. | 213/223 |

*Primary Examiner*—Mark T. Le
*Attorney, Agent, or Firm*—James E. Bradley; Grady K. Bergen

[57] ABSTRACT

A railcar cushioning device for absorbing impact between railcars is provided having a hydraulic cylinder containing hydraulic fluid. A piston locates within the cylinder and is movable relative to the cylinder between an extended position and a contracted position in response to draft and buff forces. First and second sensors are provided with the piston and cylinder for detecting movement of the piston and cylinder substantially between the contracted and extended positions. By means of a suitable logic circuit or microprocessor, the period of time that it takes for the piston and cylinder to move between the contracted and extended positions can be monitored to determine if the period of time is less than a preselected amount thus indicating that the cushioning unit has failed. A counter may also be provided to count the number of times that the cushioning unit has failed. After the number of failures reaches a selected number, an output may be provided by means or a readout display or transponder indicating that the cushioning unit has failed.

20 Claims, 8 Drawing Sheets

CUSHIONING UNIT FAULT DETECTOR

BACKGROUND OF THE INVENTION

1. Field of the Invention

This invention relates to a cushioning device for absorbing shock between railway cars, and in particular, to a cushioning unit having a detection device for indicating failure of the cushioning unit.

2. Description of the Prior Art

Railcars experience a great deal of shock during coupling operations and other train action. This shock can damage cargo on the railcars and the railcars themselves. To absorb the high forces experienced by railcars during these operations, cushioning devices have been employed between the frame of the railcar and its couplers. These shock absorbers absorb shock energy induced when the car is pushed into other cars during coupling operations. Shock energy is also absorbed during "over-the-rail" operations when adjacent coupled cars develop relative motion with respect to the adjacent freight car.

The shock experienced by railcars results from both buff and draft forces applied to the coupler of the railcar. The term "buff" is used to describe the movement experienced by a coupler when it is moved toward its associated railcar. These buff forces are usually experienced during coupling operations between the railcars. "Draft" describes the outward movement of the coupler away from its associated railcar in response to pulling forces acting on the coupler.

The shock absorber is commonly referred to as a cushioning unit and is comprised of a hydraulic cylinder and a piston. The cylinders are filled with a hydraulic fluid which is forced through small diameter ports in the cylinder wall in response to impact force applied to the piston. Spring means and sometimes pressurized gas are used to supply a restoring force for the cushioning unit. Difficulty has been encountered in the past in testing these cushioning units once they are installed on the railcar. Prior methods of testing these cushioning units involve pushing the cars with a locomotive into an adjacent car to see how fast the cushioning unit responds. Depending upon how fast the cushioning unit responds, an observer can determine if the cushioning unit is defective. Failure of the cushioning unit can often be attributed to a broken piston shaft, a broken piston or loss of hydraulic fluid.

In gas restored cushioning units, another method of determining whether the cushioning unit is defective is to provide a pop-up type pressure valve which responds to a preselected low pressure within the cylinder. When the pressure within the cylinder drops below this preselected level a stem of the pressure valve pops in to indicate that the cushioning unit has lost restoring gas pressure. While this method determines lost gas pressure, it does not activate for most normal failure modes. The pop-up valve may also indicate a defective unit even though the cushioning unit is properly restoring.

This indirect approach of determining failure of the cushioning unit does have disadvantages. Because the use of a pressure valve only gives an indication that the pressure within the hydraulic cylinder is below a preselected level, the failure of a cushioning unit due to broken piston head, broken piston shaft or other common problem would not necessarily be indicated using the pressure valve.

What is therefore needed is a detection device or a method of detecting failure of a cushioning unit on a railcar which can be used without having to actuate the cushioning unit itself other than observing or inspecting the detection device. The need also exists to be able to isolate the unit being tested from units on other railcars and the type of activity causing the cushioning unit movement.

SUMMARY OF THE INVENTION

A railcar cushioning device for absorbing shock between railcars is provided having a hydraulic cylinder containing hydraulic fluid. A piston locates within the cylinder and is movable relative to the cylinder between an extended position and a contracted position in response to draft and buff forces. Sensor means, which may include first and second sensors, are provided with the piston and cylinder. Each sensor produces an initiation signal in response to movement of the piston and cylinder substantially between one of the extended and contracted positions. Detection means detects the period of time between each initiation signal and indicates when the period of time is less than a predetermined amount thus indicating that the cushioning unit has failed.

DETAILED DESCRIPTION OF THE INVENTION

Figure 1:
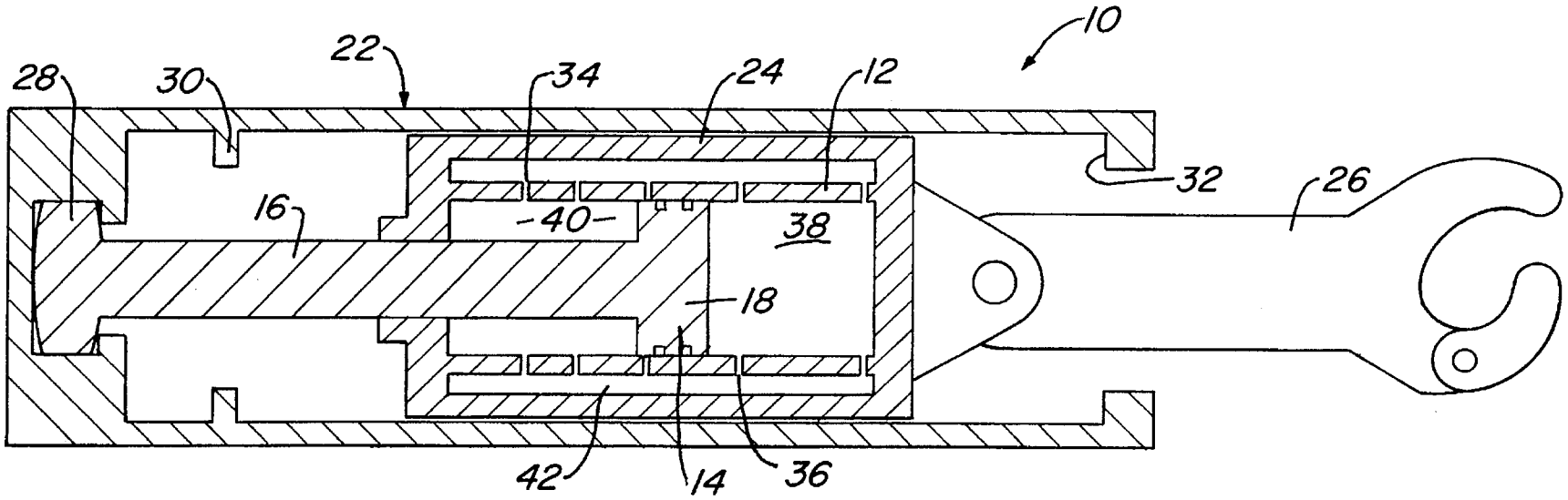
FIG. 1 is a cross-sectional plan view of a cushioning unit for a railcar constructed in accordance with the invention.

Referring to FIG. 1, a cushioning unit 10 is shown for use with a railcar of conventional design. The cushioning unit 10 is comprised of a hydraulic cylinder 12 and a piston 14 constructed from a piston shaft 16 and a piston head 18 which locates within the hydraulic cylinder 12. The piston shaft 16 is joined to the piston head 18 with the piston shaft 16 extending from the rearward or buff end of the hydraulic cylinder 12 and being secured to a box-like frame 22 having an interior. The box-like frame 22 is formed from a portion of the railcar body underframe.

The cylinder 12 is housed within a cylinder housing 24 which surrounds the cylinder 12 and is housed within the interior of the box-like frame structure 22. The cylinder housing 24 and cylinder 12 move as a unit, with the railcar coupler 26 of the railcar (not shown) being attached to the forward or draft end of the cylinder housing 24. The cylinder housing 24 and cylinder 12 are free to move within the box-like frame structure 22 in response to action on the coupler 26 of the cushioning unit 10. A buff stop 30 located at the rearward end of the box-like frame structure 22 limits the cylinder housing 24 and cylinder 12 from further rearward movement within the box-like frame structure 22 when subjected to buff forces. A draft stop 32 is also provided on the box-like frame structure 22 opposite the buff stop 30 to prevent forward movement of the cylinder 12 and cylinder housing 24 within the box-like frame structure 22 in response to draft forces.

Formed in the wall of the hydraulic cylinder 12 are a plurality of small diameter ports 34, 36 located at various positions along the length of the cylinder 12. As seen in FIG. 1, the piston head 18 locates within the hydraulic cylinder 12 so that during movement of the cylinder 12 within the frame structure 22, the piston head 18 divides the area within cylinder 12 into spaces 38 and 40. These spaces 38,40 contain a mixture of oil and nitrogen gas which is under pressure. The cylinder 12 is spaced radially inward from the cylinder housing 24 to define an annular space 42 between the exterior of the cylinder 12 and the inner wall of the cylinder housing 24.

Figure 2:
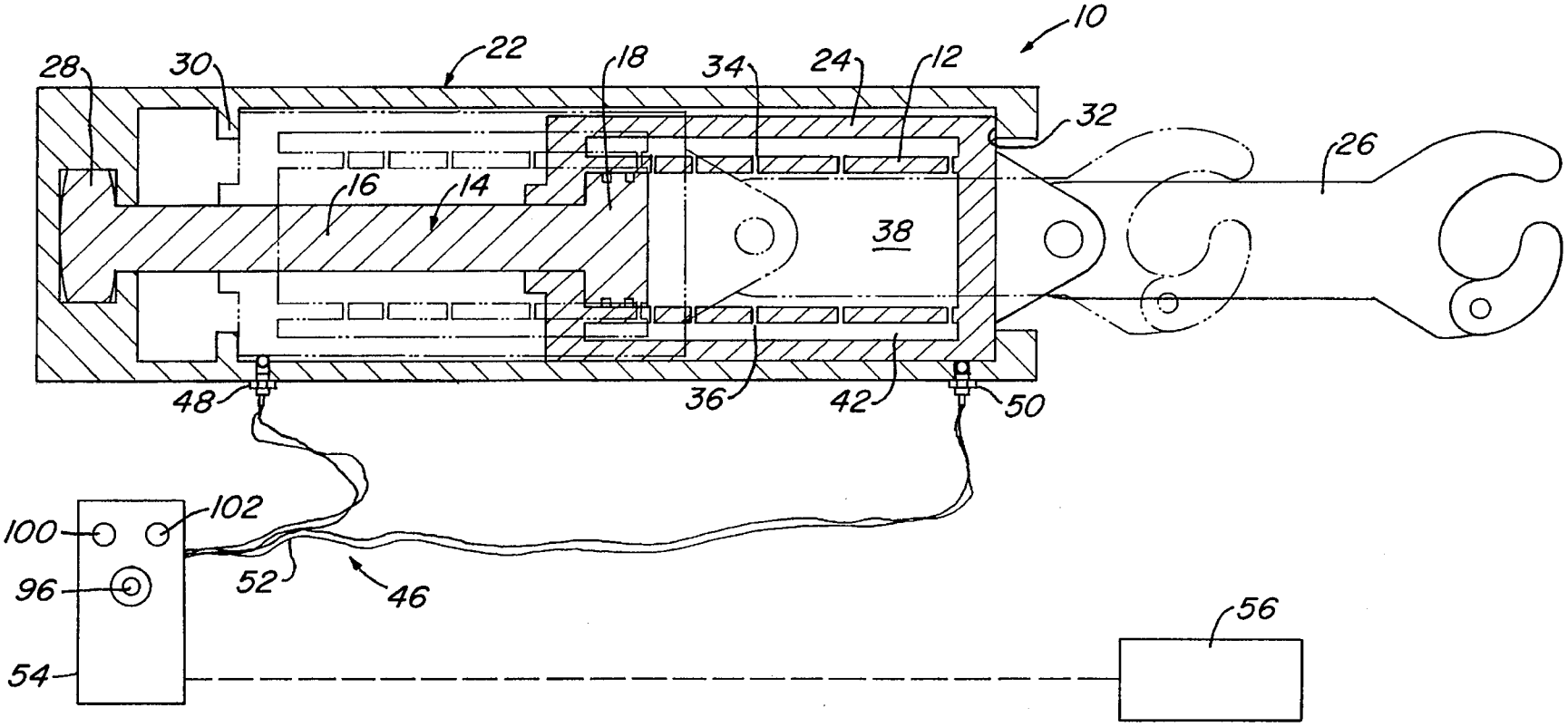
FIG. 2 is a cross-sectional plan view of the cushioning unit of FIG. 1 shown with a detection device for indicating failure of the cushioning unit and constructed in accordance with the invention.

Referring to FIG. 2, the normal position of the cushioning unit 10 when the cushioning unit 10 is at rest is in the fully extended position such that the cylinder housing 24 abuts against the draft stop 32 of the box structure 22. This is shown by the solid lines of FIG. 2. There is normally a spring assembly (not shown) that provides a small preload force against the cylinder housing 24 so that the cylinder housing 24 is urged to its normally extended position against the draft stop 32. Alternatively, the cushioning unit can be precharged with nitrogen gas which causes the unit 10 to seek this normally extended position against the draft stop 32. A broken spring or loss of this nitrogen gas will prevent the unit from seeking its normally extended position.

Because the box-like structure 22 of the railcar prevents the cushioning unit from being visible and easily inspected, a detection device 46 constructed in accordance with the invention is provided with the cushioning unit 10. The detection device 46 is comprised of a pair of limit switches 48, 50. The switch 48 is a buff switch and is located at the buff end of the box-like structure 22, approximately one inch forward of the buff stop 30. The switch 50 is a draft switch and is located at the opposite end of the box-like structure 22, approximately one inch to the rear of the draft stop 32. The switches 48, 50 are provided with wiring 52 which connects the switches 48, 50 to a battery powered electronic detection module 54. A transponder 56, such as the "Passive Alarm Tag" available from Amtech Systems, Corp., may also be electrically coupled to the detection module 54 to transmit a signal to a wayside reader (not shown). The switches 48, 50 may be any electromechanical proximity switch or sensor known to those skilled in the art which can be actuated by the movement or proximity of the cylinder 12, cylinder housing 24, or piston 14.

As shown in FIG. 2, the switches 48, 50 are mounted to the box-like structure 22 and are comprised of spherical conducting members or balls which are spring biased inwardly into the interior of the box-like frame structure 22 and into contact with the exterior of the cylinder housing 24 as the cylinder housing 24 is moved within the box structure 22. When the cushioning unit 10 is in the fully extended position, with the cylinder housing 24 abutting against the draft stop 32, the draft switch 50 will contact the exterior of the cylinder housing 24 so that the spherical member of the draft switch 50 is forced outwardly to an open position. The buff switch 48 located at the buff end of the structure 22 is in a normally open condition when the cylinder housing 24 is in this fully extended position.

During normal operation of the cushioning unit 10, the speed at which the cylinder housing 24 moves during a shock absorption situation is significantly retarded by the effect of the hydraulic fluid located within the spaces 38, 40 of the cylinder 12 as it is forced through the ports 34, 36. A buff force acting on the coupler 26 will cause the cylinder 12 and cylinder housing 24 to be moved to a contracted position toward the buff end of the box-like structure 22 along the piston shaft 16 so that the piston head 18 acts upon the hydraulic fluid within the cylinder 12. The pressure exerted by the piston head 18 causes the hydraulic fluid located within the interior space 38 of the cylinder 12 to be forced through ports 34, 36 located within the cylinder wall of the cylinder 12 and into the annular space 42. The hydraulic fluid is returned into the space 40 of the cylinder 12, behind the piston head 18, through the ports 34, 36. Movement of the cylinder 12 and cylinder housing 24 is eventually prevented by the buff stop 30 when the cushioning unit 10 is fully contracted.

When the cushioning unit 10 is in the fully contracted or compressed position, as shown by the dashed lines of FIG. 2, with the cylinder housing 24 abutting the buff stop 30, a draft force acting on the coupler 26 causes the cylinder 12 and cylinder housing 24 to move toward the draft stop 32 along the piston shaft 16. This causes the piston head 18 to be forced through the interior of the cylinder 12 so that hydraulic fluid located within the space 40 is forced through the ports 34, 36 and back into the space 38 located forward of the piston head 18. When the cushioning unit 10 is operating properly, movement of the cylinder 12 and cylinder housing 24 between these contracted and extended positions in response to draft and buff forces will take several seconds.

Figure 3:
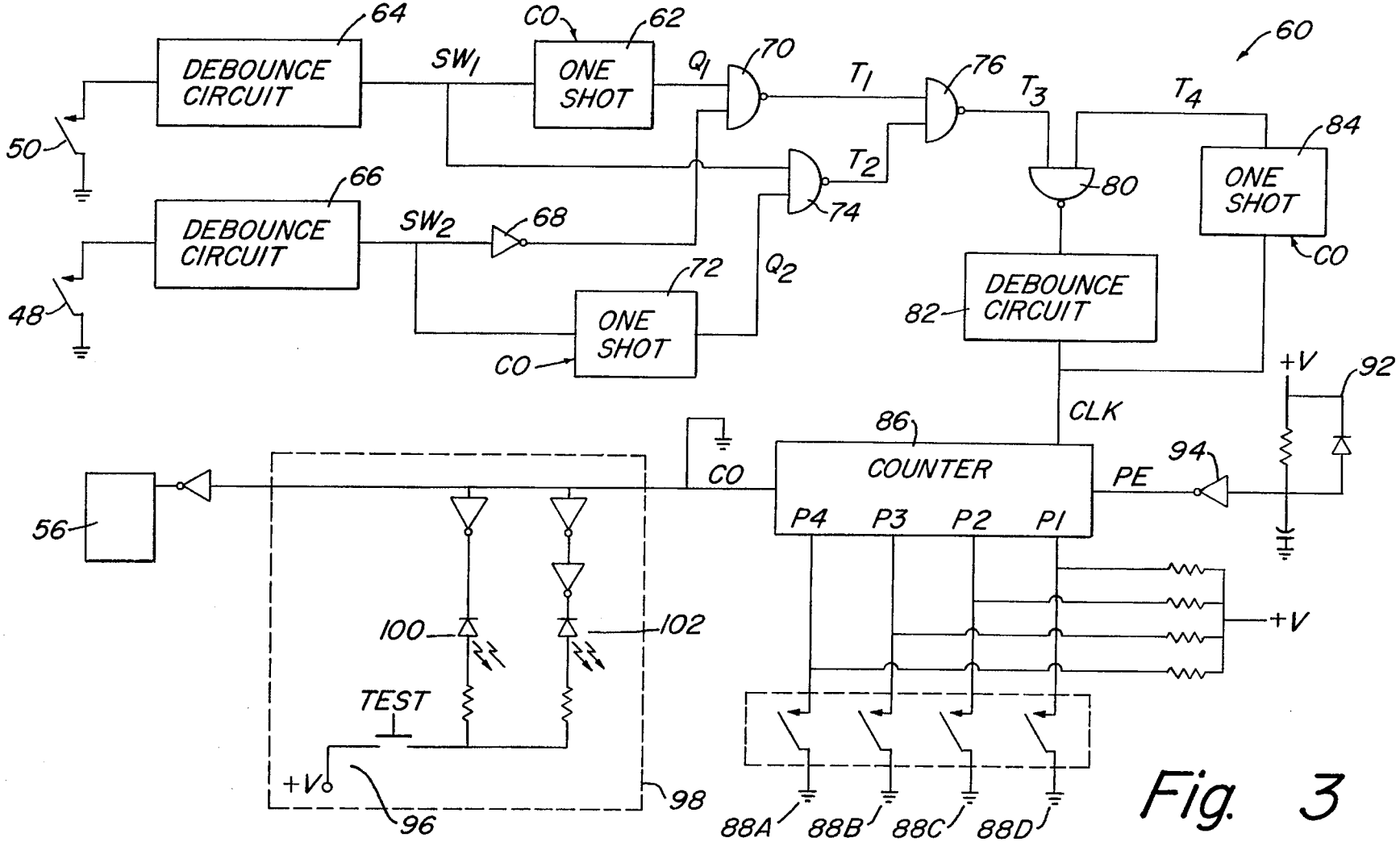
FIG. 3 is a schematic diagram of a logic circuit for use in the detection device of FIG. 2 and constructed in accordance with the invention.

When the cushioning unit 10 is defective or faulty due to a broken piston shaft, a broken piston, or loss of hydraulic fluid, the cylinder housing 24 and cylinder 12 will traverse the distance between the draft and buff stops 32, 30 in a fraction of the time required for the cushioning unit 10 to traverse this distance during normal operation. Based upon this principle, a design for a logic circuit 60, which is shown in FIG. 3, is employed for detecting the faulty status of the cushioning unit 10.

The logic circuit 60 is housed within the detection module 54 and is connected to the sensors 48, 50 by the wiring 52. As seen in FIG. 3, the draft switch 50 is connected to a one-shot multivibrator 62 via a debounce circuit 64 used to eliminate ringing of the switch 50. When the cylinder housing 24 and cylinder 12 are in the fully extended position, the switch 50 remains open as previously described. The switch 50 is connected to ground so that when the switch 50 is closed, an initiation signal SW1 passes through debounce circuit 64 to the one-shot 62. In response to the initiation signal SW1 generated by the switch 50, the one-shot 62 produces a pulse Q1. The pulse Q1 should last for about ¼ second to correspond to the reduced time required for the cylinder 12 and cylinder housing 24 to traverse the distance from the draft stop 32 to the buff stop 30 when the unit 10 has failed. The type of one-shot 62 and the time period of the pulse Q1, however, may be selected to satisfy the specific function and requirements of the cushioning unit 10.

The buff switch 48 located at the buff or rearward end of the box structure 22 is normally in the open position when the cylinder housing 24 is in the extended position. When the cylinder 12 is contracted in response to buff forces, such as those exerted from the adjacent railway car to which the coupler 26 is coupled, the cylinder housing 24 contacts the switch 48 as the cylinder housing 24 approaches the buff stop 30. This closes the switch 48 so that an initiation signal SW2 is generated. As shown in FIG. 3, the buff switch 48 is electrically coupled to the debounce circuit 66. The initiation signal SW2 from the switch 48 is inverted by an inverter 68 and is received by a NAND gate 70. The NAND gate 70 also receives the pulse Q1 generated by the one-shot 62. A signal T1 is produced by the NAND gate 70 in response to the inputs of Q1 and the inverted SW2.

If the cushioning unit 10 experiences draft forces while in the contracted position, the cylinder housing 24 will move in the draft direction. This causes the buff switch 48 to reopen after the cylinder housing 24 passes. The change in signal SW2 causes a second one-shot multivibrator 72 to generate a second pulse Q2 which is received by NAND gate 74. As the cylinder housing 24 continues to move toward the fully extended position, the draft switch 50 will reopen thus changing the state of initiation signal SW1. If the change in the signal SW1 is received within the period of the pulse Q2 from the second one-shot 72, a signal T2 will be generated by the NAND gate 74. The pulse Q2 generated by the one-shot 72 should last about ¾ second to correspond to the time it takes for the cylinder housing 24 to move from the buff stop 30 to the draft stop 32 when the cushioning unit 10 is malfunctioning. Again, however, this time period can be chosen to satisfy individual needs and designs of the cushioning unit 10.

The signals T1, T2 are both input to a NAND gate 76. If either T1 or T2 indicates failure of the cushioning unit 10 when the cushioning unit 10 is moved to the contracted or extended positions as described above, the NAND gate 76 generates an error signal T3 which is input to NAND gate 80. The output from NAND gate 80 is received by a debounce circuit 82 which delays the output of NAND gate 80. The delayed output CLK from the debounce circuit 82 triggers a third one-shot multivibrator 84 to generate a masking pulse T4 of a given duration which is fed back to the NAND gate 80. The output CLK from the debounce circuit 82 is also received by a counter 86. The masking signal T4 masks the signal T3 so that the output of the NAND gate 80 goes to its initial state after receiving the error signal T3. This causes the CLK signal to appear as a pulse which is counted by the counter 86.

The counter 86 is loaded with a selected fault count which is set by dip switches 88A–88D connected to the counter 86 through connections P1–P4. The fault count is set when power is applied to the program enable input of the counter 86 through the use of an RC circuit 92. The output of the RC circuit 92 is connected to the counter 86 through an inverter 94 so that the settings defined by the dip switches 88A–88D are loaded into the counter 86 when power is applied. The output of the inverter 94 is high for the duration set by the RC time constant of the RC circuit 92 connected through the inverter 94, and the DIP switch 88A–88D settings are loaded into the counter 86 when the signal PE goes low.

For each pulse CLK generated by the NAND gate 80 and debounce circuit 82, the counter 86 counts down one count until zero is reached. When zero has been reached, the counter 86 will generate a logical high carry-out signal CO. This carry-out signal CO is received by each of the one-shots 62, 72, 84 so that the one-shots 62, 72, 84 are disabled and further CLK signals are no longer produced. This prevents the counter 86 from continuing to count, and resetting the carry-out signal CO.

A button or test switch 96 on the module 54 of FIG. 2 powers a status circuit 98. The status circuit 98 is connected to the counter 86 and receives the carry-out signal CO. The status circuit 98 has a red LED 100 for indicating that the carry-out signal CO is at its selected value and the cushioning unit 10 has failed. A green LED 102 is also provided with the circuit 98 for indicating that the carry-out signal CO given by the counter 86 is at other than the selected value to indicate that the cushioning unit 10 is functioning properly. The carry-out signal CO is also transmitted to the transponder 56 which provides a signal indicating the good or bad condition in response to a query signal from a wayside reader or antenna (not shown) located along a length of track as the railcars pass by.

Figure 4:
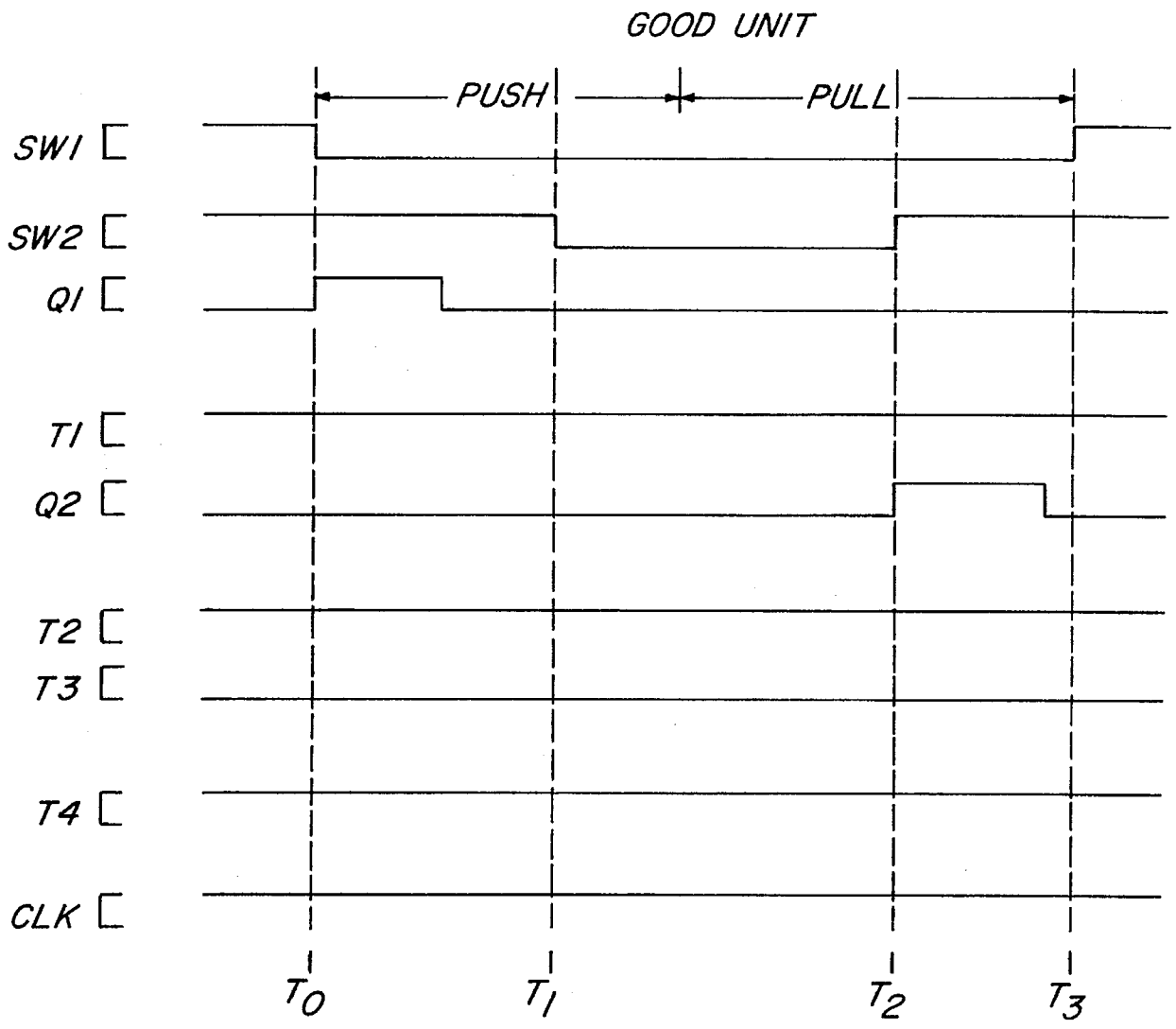
FIG. 4 is a timing diagram of the logic circuit shown in FIG. 3 showing the response of a good cushioning unit.

The operation of the logic circuit 60 of the detection device 46 is as follows. FIG. 4 shows a timing diagram showing the various signal states generated by the logic circuit 60 for a good cushioning unit 10 during contraction and extension of the piston and cylinder 12, 14. For a properly functioning cushioning unit, at $t_0$, the cylinder housing 24 clears the draft switch 50 in response to buff forces so that draft switch 50 closes causing signal SW1 to go low. This triggers the one-shot 62 to cause the signal Q1 to go high for a period of time. At $t_1$ the cylinder housing 24 reaches the buff switch 48 so that it closes and the inverted signal SW2 from inverter 68 goes low. As can be seen, the signal Q1 goes low prior to $t_1$ so that the output of NAND gate 70, signal T1, remains high. The remaining signals T3, T4, CLK also remain unchanged so that no CLK input pulse is counted by the counter 86.

As the good cushioning unit is extended from the contracted position in response to draft forces, the cylinder housing 24 passes the buff switch 48 at $t_2$. The change in signal SW2 triggers the one-shot 72 to cause signal Q2 to go high for a period of time. As the cushioning unit 10 continues to extend, the cylinder housing 24 contacts the draft switch 50 at $t_3$ so that draft switch 50 opens and signal SW1 goes high again. The signal Q2, however, goes low prior to $t_3$ so that the signal T2 from NAND gate 74 remains unchanged as do signals T3, T4 and CLK. Thus, no count is counted by counter 86, and the carry-out signal CO is unchanged. If a user pushes the test switch 96, the green LED 102 will light, indicating the cushioning unit is in good condition. The transponder 56 will also indicate a good condition when queried.

Figure 5:
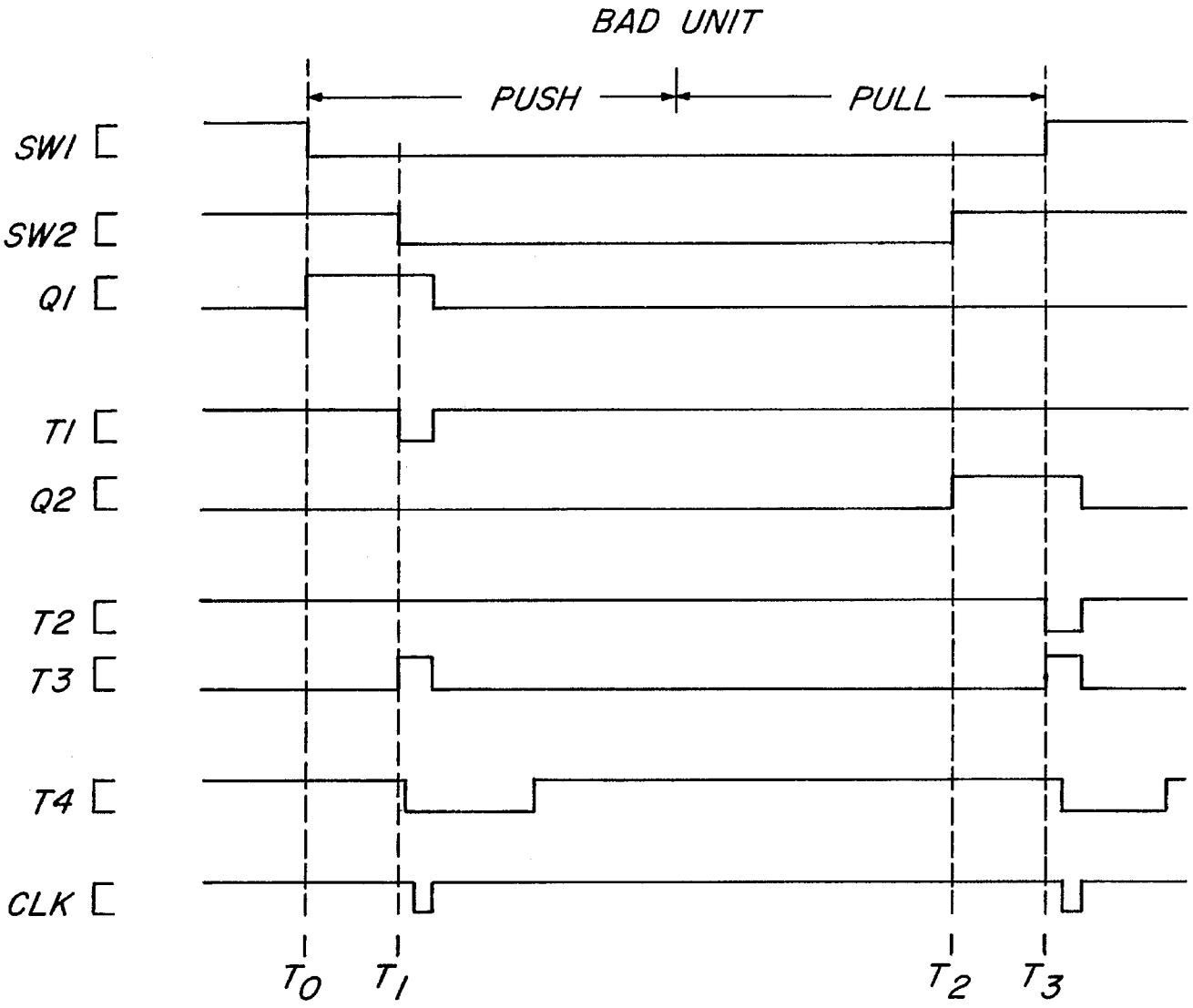
FIG. 5 is a timing diagram of the logic circuit shown in FIG. 3 showing the response of a defective cushioning unit.

Referring to FIG. 5, a timing diagram is shown illustrating signals which are generated during use of a failed cushioning unit. At $t_0$ the cylinder housing 24 clears the draft switch 50 so that signal SW1 goes low and triggers the one-shot 62 to cause Q1 to go high for a period of time. At $t_1$, the cylinder housing 24 contacts the buff switch 48 so that it closes and the inverted signal SW2 goes low. As can be seen from the timing diagram, this occurs quickly due to the defective condition of the cushioning unit. Q1 remains high at $t_1$, thus causing output T1 from NAND gate 70 to go low. This causes NAND gate 76 to generate a high output T3 which, in turn, causes the NAND gate 80 to generate a low signal which is delayed by the debounce circuit 82. The delayed output from the debounce circuit 82 triggers the one-shot 84 to generate a low output T4 from the one-shot 84 which qualifies the high signal T3 input to NAND gate 80 so that the output of NAND gate 82 goes high again. The low pulse T4 generated by the one-shot 84 should last long enough to ensure that T3 goes low before T4 goes high again. The initially delayed output from the debounce circuit 82 is received by the counter 86 as a low pulse of the CLK signal which causes the counter to count down one count.

Still referring to FIG. 5, as the defective cushioning unit 10 is extended from the contracted position in response to draft forces, the cylinder housing 24 passes the buff switch 48 at $t_2$. The change in signal SW2 triggers the one-shot 72 to cause the signal Q2 to go high for a period of time. The defective cushioning unit 10 extends quickly so that the cylinder housing 24 contacts the draft switch 50 at $t_3$, opening draft switch 50 and causing signal SW1 to go high while the signal Q2 remains high. This causes the NAND gate 76 to generate another high output T3 which is received by NAND gate 80 which generates a low signal in response. The delayed output from the debounce circuit 82 triggers the one-shot 84 to generate a low output T4 which qualifies the high signal T3 so that the output of NAND gate 82 goes high again. Again, the low pulse T4 generated by the one-shot 84 should last long enough to ensure that T3 goes low before T4 goes high. The initial low output from the NAND gate 80 which is delayed by the debounce circuit 82 is again received by the counter 86 as a low pulse of the CLK signal, causing the counter 86 to count down another count.

It should be noted that if for some reason the signal T3 remains continuously high for periods longer than the individual pulses of Q1 and Q2, for example if T1 and T2 are immediately generated one after the other, the qualifying signal T4 will allow a low pulse to be generated periodically by the NAND gate 80 so that the counter 86 will continue to count down one count at a time until the signal T3 returns to its normally low state. When the counter 86 has counted down the preset number of counts the carry-out signal CO produced by the counter 86 is set to its selected value indicating failure. If the user pushes test button 96, the red LED 102 will light, visually indicating to the user that the cushioning unit 10 has failed. The transponder 56 will also indicate a bad condition for the cushioning unit 10 when queried.

Current is drawn to power the detection device only when the logic circuit makes a change in state in response to the cushioning unit 10 undergoing compression or extension. Because there is no current flowing while the cushioning unit 10 is at rest, the detection device requires very little power, enabling batteries to be used so that the detection device is self-contained. This allows the detection device to be easily added to pre-existing cushioning units with only minor modifications.

Figure 6:
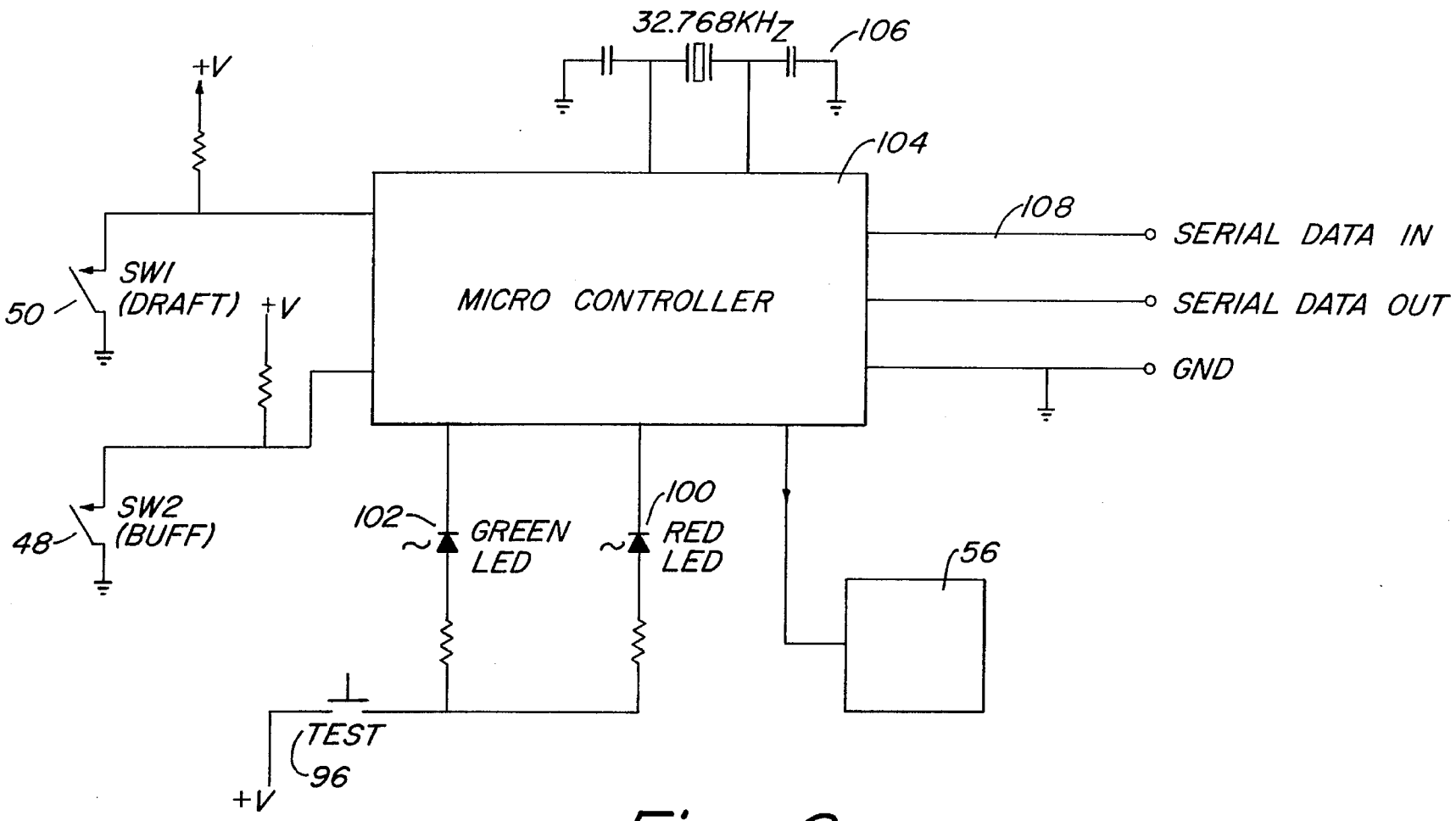
FIG. 6 is a schematic diagram of a microprocessor for use in the detection device of FIG. 2 and constructed in accordance with the invention.

FIG. 6 shows another embodiment of the invention wherein the buff and draft switches 48, 50 are connected to a microprocessor 104. The microprocessor 104 could be that such as the PIC16C84 microprocessor, available from Microchip Technologies, Inc. The microprocessor 104 is battery powered and may be housed within the detection module 54 of FIG. 2. The microprocessor 104 is provided with a clock crystal 106 which provides a clock signal for timing of events and operation of the microprocessor 104. Output from the microprocessor 104 is provided to the red and green LEDs 100, 102 which are activated by means of the test switch 96. In addition, an output from the microprocessor 104 can be directed to the transponder 56 to indicate the condition of the cushioning unit 10 when queried. The microprocessor 104 has a serial data interface 108 wherein data for setting parameters of the detection device 46 can be input to the microprocessor 104.

Figure 7A:
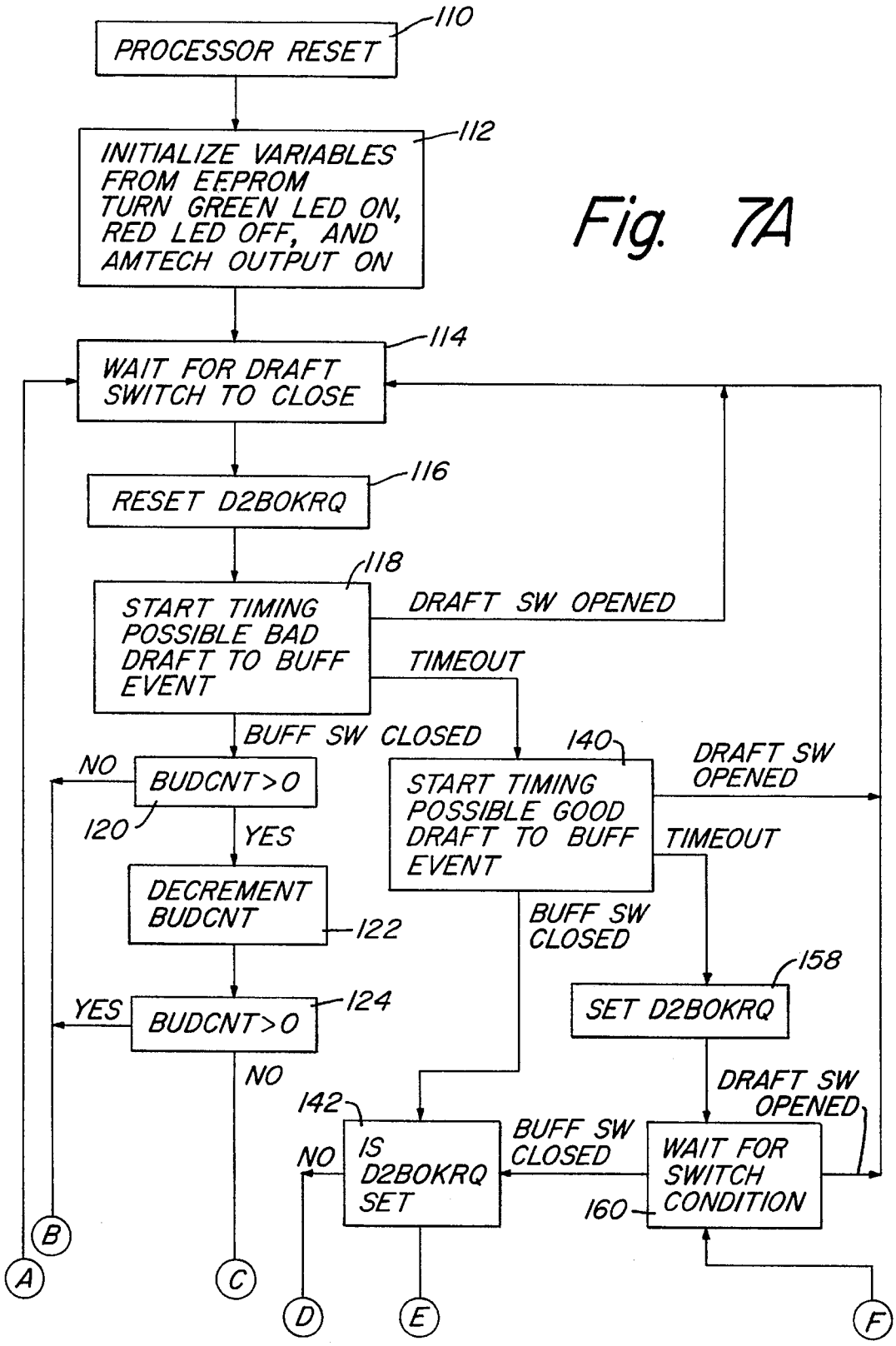
FIG. 7 is a flow diagram of the process implemented in the microprocessor of FIG. 6.
Figure 7B:
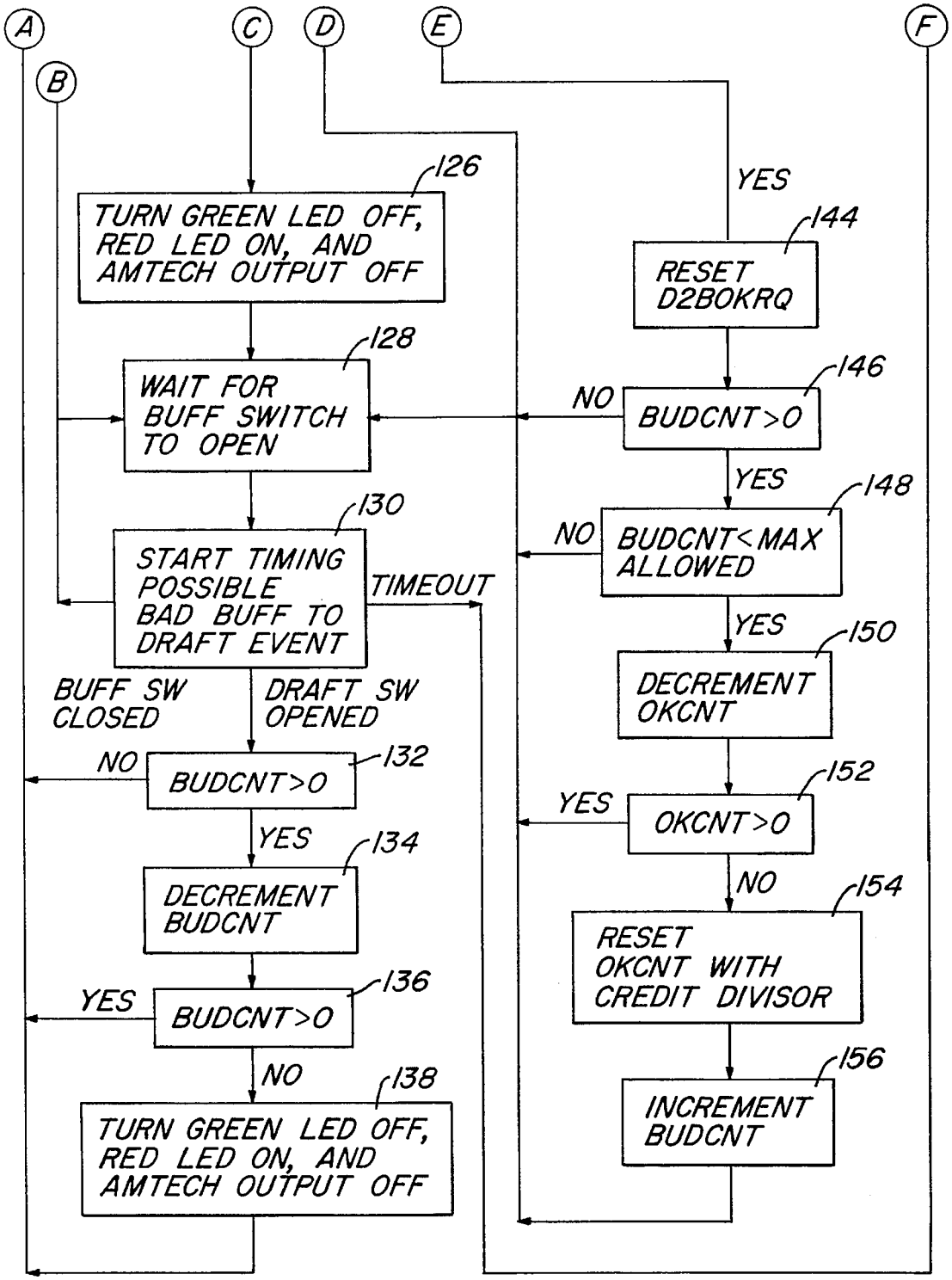

FIG. 7 shows a process flow diagram for the process implemented in the microprocessor 104 of FIG. 6. The process begins at block 110 wherein the processor 104 is set to begin the detection of events of the cushioning unit 10. Thereafter the process proceeds to block 112, which depicts the initialization of variables from an EEPROM of the microprocessor 104. Initially, the green LED 102 is caused to light when the test switch 96 is depressed. The transponder 56 is also caused to produce an output indicating a good condition for the cushioning unit 10. The process then proceeds to block 114, which illustrates awaiting for the draft switch 50 to close to produce the initiation signal in response to buff forces acting upon the cushioning unit 10. When the draft switch 50 closes, the process proceeds to block 116 wherein a timing complete flag for good draft to buff events, denoted by D2BOKRQ, is reset. When the timing of a possible good draft to buff event is complete, the D2BOKRQ flag is set so that a good event counter OKCNT can be updated when the buff switch 48 finally closes. This is discussed in further detail in the description to follow.

When the draft switch 50 closes and the D2BOKRQ flag is reset, the process proceeds to block 118, which illustrates the starting of a time interval, typically less than one second, of possible bad draft to buff events. If the draft switch 50 opens without the buff switch 48 closing and before the time interval for bad draft to buff events is complete, the process returns to block 114 to wait for the draft switch to close again. This occurs when the cushioning unit 10 undergoes only slight buff forces so that the cylinder 12 does not travel all the way to the buff switch 48. No event is counted when the cushioning unit 10 is thus returned to the full draft position.

If the buff switch 48 closes before the expiration of the timing interval for bad draft to buff events, the process continues to decision block 120 wherein the cushioning unit status is determined. A cushioning unit status counter is indicated as BUDCNT which, when greater than zero, indicates a good status. When the BUDCNT is greater than zero, it is decremented at block 122, for each event indicating a possible bad cushioning unit. Once the zero or bad status of the BUDCNT is reached, it can only be reset by removing the battery from the detection device or by command via serial data communications from the serial data interface 108.

After the BUDCNT is decremented at block 122, the process then proceeds to decision block 124 where it is again determined if the BUDCNT is greater than zero. If the BUDCNT has now become zero, the process continues to block 126 which illustrates the green LED 102 being turned off and the red LED 100 being turned on. The transponder output is also turned off to indicate a bad cushioning unit.

If at block 124, the BUDCNT is greater than zero, the process proceeds to block 128 which illustrates waiting for the buff switch 48 to open. If the BUDCNT is not greater than zero at block 120 after the buff switch 48 closes, the process proceeds from block 120 to block 128. From block 128, when the buff switch 48 opens the process continues to decision block 130 where possible bad buff to draft events are timed. This time interval is also typically less than one second. If the buff switch 48 closes before the time interval for bad buff to draft events expires, the process returns to block 128 to wait for the buff switch 48 to open. If the draft switch 50 opens before the time interval for bad buff to draft events expires, the process continues to decision block 132 for determining whether the BUDCNT is greater than zero. If the BUDCNT is not greater than zero, the process returns to block 114. If it is greater than zero, the BUDCNT is decremented by one count as is shown in block 134 to indicate a bad event. From block 134, the process proceeds to decision block 136 to determine whether the BUDCNT is greater than zero after it has been decremented. If no, the process proceeds to block 138 which illustrates the green LED 102 being turned off, the red LED being turned on and the output from the transponder being turned off to indicate a bad cushioning unit. If the BUDCNT is still greater than zero at block 136, the process returns to block 114.

Returning to block 118, as described above, if after the draft switch is closed in response to action on the cushioning unit 10 and is then opened before the timing interval for bad draft to buff events is reached, the process will return to block 114 to wait for the draft switch to close again. If at block 118, the time interval for bad draft to buff events expires without the buff switch 48 closing and the draft switch 50 opening, the process proceeds to block 140 where the timing of possible good draft to buff events is started. The time interval for good draft to buff events is usually several seconds long. If the buff switch 48 closes before the expiration of the timing interval for good draft of buff events expires, the process continues to decision block 142 for determining whether the D2BOKRQ is set. If the D2BOKRQ is not set, which it will not be when block 142 is reached from block 140, the process proceeds to block 128 described previously.

If the D2BOKRQ is set, the process continues to block 144 where the D2BOKRQ is reset. The process then continues to decision block 146. At block 146, if the BUDCNT is not greater than zero, the process proceeds to block 128. If the BUDCNT is greater than zero, the process continues to block 148 where it is determined whether the BUDCNT is less than a maximum allowed value as set in the EEPROM. If no, the process continues to block 128. If yes, the process proceeds to block 150 where the good event counter OKCNT is decremented, and on to decision block 152 where it is determined whether the OKCNT is greater than zero. If yes, the process proceeds to block 128 to wait for the buff switch 48 to open. If no, the process continues to block 154 where the OKCNT is reset with a credit divisor equal to a selected number, N, of good events. This credit or good event divisor is set in the EEPROM and is used for an initial and reset value for the OKCNT. The OKCNT is reset to the number of good counts required for credit so that the BUDCNT is incremented, as is illustrated at block 156.

From block 156, the process returns to block 128. In this way the BUDCNT value can be increased after every N good events to compensate for instances such as when the cushioning unit 10 is subjected to extremely high buff forces which might be recorded as bad draft to buff events. Thus, if a cushioning unit is not defective, but the detection device has recorded some bad draft to buff events, these will eventually be disregarded with the continued proper operation of the cushioning unit 10. Although not shown, it is within the scope of the invention that false bad buff to draft events could be compensated for in a similar manner as well.

Returning to block 140, if the draft switch 50 opens before the time interval for good draft to buff events is complete, the process proceeds to block 114. If, however, the buff switch 48 remains open after the good draft to buff time interval, the process thereinafter proceeds to block 158 which illustrates setting of the D2BOKRQ flag. This allows the compensation good count. The process then proceeds from block 158 to decision block 160 which illustrates waiting for a switch condition. If the buff switch 48 closes, the process continues to block 142 where the process proceeds as previously described. If, however, the draft switch 50 opens thereafter, the process returns to block 114 where the process awaits for the draft switch 50 to close again. At block 130, where the timing of possible bad buff to draft events is commenced, if the draft switch 50 opens after the expiration of the timing interval for bad buff to draft events, the process continues to block 160, which has been previously described, to wait for either the buff switch 48 to close or the draft switch 50 to open.

By means of the microprocessor 104 using the above described process, the detection unit can detect failure of the cushioning unit when subjected to both buff and draft forces. If the cushioning unit 10 does not contract or extend within preselected time periods, the cushioning unit is presumed to be working properly and no "bad event" is generated or counted. If the cushioning unit 10 compresses or extends within the preselected time periods, a bad event is generated or counted.

The BUDCNT cushioning unit status counter allows a selected number of bad events to occur before a failure status of the cushioning unit is indicated. If before any failure status is given, the process allows the BUDCNT to be incremented for proper functioning of the cushioning unit 10. This occurs when the cushioning unit 10 takes longer than a selected time period to contract, thus indicating proper functioning. If one or more "good counts" are generated, the BUDCNT can be compensated for this proper functioning.

The detection unit utilizing the microprocessor 104 also accounts for operations where the cushioning unit 10 is not fully extended or contracted. If the cushioning unit 10 returns to its previous condition, without fully extending or contracting, neither a good or a bad count is generated. The device merely waits for the next event to occur.

The cushioning unit and detection device of the invention have several advantages over the prior art. The detection device allows an observer to check the cushioning units of railway cars by merely pushing the test button provided with the detection module so that one of the indication lights indicates either a good or a bad condition. It is not necessary to actuate the cushioning unit in order to visually observe whether or not the cushioning unit has failed. By setting the number of bad events at a high enough number and/or providing means for incrementing the bad counts with subsequent normal operation of the cushioning unit, possible false counts arising from extremely high impacts can be discounted. The simple switches and electronic circuitry of the detection device of the cushioning unit are less prone to failure in comparison to the mechanical pop-up valve detection devices used in the prior art. Also the detection device detects failure even when the pressure within the cylinder remains the same, such as when the piston shaft is broken. This overcomes the shortcomings of the pressure-type sensors which only indicate whether the pressure within the hydraulic cylinder drops below a preselected level. The transponder also allows one to read from a distance whether the cushioning unit has failed. This could be employed as the railcars pass along a length of track which is fitted with an antenna for reading the status of each cushioning unit as the railcars pass by.

While the invention has been shown in only one of its forms, it should be apparent to those skilled in the art that it is not so limited but is susceptible to various changes without departing from the scope of the invention. For example, a different logic circuit or microprocessor could be employed which would give the same type of output. The detection module could be used to indicate the actual number of counts the counter has counted down instead of only indicating a bad or good condition. Sensors could be used besides limit switches to detect movement of the piston and cylinder.

We claim:

1. A railcar cushioning device for absorbing shock between railway cars, the cushioning device comprising in combination:

a hydraulic cylinder containing hydraulic fluid;

a piston which locates within the cylinder, the piston and cylinder being movable relative to the other between an extended position and a contracted position in response to draft and buff forces;

sensor means for detecting movement of the piston and cylinder substantially between the extended and contracted positions; and comparison means which determines the period of time required for the piston and cylinder to move substantially between the extended and contracted positions, compares the period of time to a predetermined amount, and indicates when the period of time is less than the predetermined amount.

2. The cushioning device of claim 1, wherein:

the comparison means has a counter which counts a number for each period of time that is less than the predetermined amount, the comparison means producing an output when the number reaches a preselected value.

3. The cushioning device of claim 1, wherein:

the comparison means has a transponder adapted for sending a signal to a remote receiver to indicate that the period of time is less than the predetermined amount.

4. The cushioning device of claim 1, wherein:

the comparison means has a readout display to give an indication when the period of time is less than the predetermined amount.

5. The cushioning device of claim 1, wherein:

the sensor means includes a pair of sensors, each sensor producing an initiation signal in response to movement of the piston and cylinder substantially between the extended and contracted positions; and the comparison means receives the initiation signal from each sensor and detects the period of time between the initiation signals, and indicates when the period of time is less than the predetermined amount.

6. The cushioning device of claim 1, wherein:

the comparison means includes a microprocessor which is programmed to determine the period of time required for the piston and cylinder to move substantially between the extended and contracted positions and which compares the period of time to a predetermined amount and indicates when the period of time is less than the predetermined amount.

7. The cushioning device of claim 5, wherein the comparison means comprises:

a detection circuit which receives the initiation signal from each sensor and detects the period of time between the initiation signal, the detection circuit producing an error signal for each period of time that is less than the predetermined amount;

an error condition circuit which receives the error signals, the error condition circuit having a counter which counts the number of error signals and produces an output signal having a first value when the number of error signals received from the detection circuit reaches a preselected number; and status output means which receives the output signal and produces an indication of whether the output signal has the first value, thus indicating that the cushioning device has failed.

8. The cushioning device of claim 7, wherein:

the detection circuit has a delay timer which begins measuring a selected time period in response to the initiation signal from one of the sensors, the detection circuit producing the error signal when the initiation signal from the other of the sensors is given within the selected time period.

9. The cushioning device of claim 7, wherein:

the output signal has a second value when the number of error signals received from the detection circuit is less than the preselected number; and the status output means produces a second indication of whether the output signal has the second value.

10. The cushioning device of claim 7, wherein:

the status output means includes a status output circuit which is selectively powered to give the indication that the output signal is at the first value.

11. In a railcar cushioning device for absorbing shock between railway cars, the cushioning device having a hydraulic cylinder containing hydraulic fluid and a piston which locates within the cylinder, the piston and cylinder being movable relative to the other between an extended position and a contracted position in response to draft and buff forces, the improvement comprising:

a draft sensor and a buff sensor mounted to the cushioning device, each sensor producing a first initiation signal in response to movement of the piston and cylinder substantially from the extended position to the contracted position, and each sensor producing a second initiation signal in response to movement of the piston and cylinder substantially from the contracted position to the extended position; and detection means which measures a first selected time period initiated in response to the first initiation signal from the draft sensor, the detection means detecting a first error each time the first initiation signal from the buff sensor is generated within the first selected time period, the detection means measuring a second selected time period initiated in response to the second initiation signal from the buff sensor, the detection means detecting a second error when the second initiation signal from the draft sensor is generated within the second selected time period.

12. The cushioning device of claim 11, wherein:

the detection means includes a counter which counts the number of first and second errors detected, the detection means producing an output when the number of first and second errors detected reaches a preselected number.

13. The cushioning device of claim 11, wherein:

the detection means includes a transponder adapted for sending an output to a remote receiver to indicate whether any errors have been detected.

14. The cushioning device of claim 11, wherein:

the detection means includes a readout display to indicate whether any errors have been detected.

15. The cushioning device of claim 11, further comprising:

the detection means includes a microprocessor programmed to measure the first selected time period initiated in response to the first initiation signal from the draft sensor and detect the first error each time the first initiation signal from the buff sensor is generated within the first selected time period, the microprocessor also being programmed to measure the second selected time period initiated in response to the second initiation signal from the buff sensor and detecting the second error when the second initiation signal from the draft sensor is generated within the second selected time period.

16. The cushioning unit of claim 12, wherein:

the detecting means detects a good event each time the first initiation signal from the buff sensor is generated after the expiration of the first selected time period, the detecting means decrementing the number of first and second errors counted by the counter for a given number of good events detected.

17. A method of detecting failure of a railcar cushioning device having a hydraulic cylinder containing hydraulic fluid and a piston which locates within the cylinder, the piston and cylinder being movable relative to the other between an extended position and a contracted position in response to buff and draft forces for absorbing shock between railway cars, the method comprising the steps of:

mounting sensor means to the cushioning device;

determining with the sensor means the period of time required for the piston and cylinder to move substantially between the extended and contracted positions; and providing an indication when the period of time is less than a predetermined amount.

18. The method of claim 17, wherein:

the indication is provided by a transponder which sends a signal to a remote receiver to indicate that the period of time is less than the predetermined amount.

19. The method of claim 17, further comprising:

counting the number of times the period of time is less than the predetermined amount; and producing the indication when the number of times has reached a preselected number to indicate that the cushioning device has failed.

20. The method of claim 19, further comprising:

detecting a good event each time the period of time is greater than the predetermined amount and decrementing the number of times the period of time is less than the predetermined amount for a given number of good events detected.

* * * * *